US012325837B2

(12) United States Patent
Hogendoorn et al.

(10) Patent No.: US 12,325,837 B2
(45) Date of Patent: Jun. 10, 2025

(54) LUBRICATING OIL COMPOSITIONS COMPRISING A POLYALPHAOLEFIN

(71) Applicant: CHEVRON ORONITE TECHNOLOGY B.V., Rotterdam (NL)

(72) Inventors: Richard Hogendoorn, Rotterdam (NL); Kevin Zevenbergen, Rotterdam (NL)

(73) Assignee: CHEVRON ORONITE TECHNOLOGY B.V., Rotterdam (NL)

( * ) Notice: Subject to any disclaimer, the term of this patent is extended or adjusted under 35 U.S.C. 154(b) by 0 days.

(21) Appl. No.: 17/780,361

(22) PCT Filed: Dec. 10, 2020

(86) PCT No.: PCT/IB2020/061727

§ 371 (c)(1),
(2) Date: May 26, 2022

(87) PCT Pub. No.: WO2021/124030

PCT Pub. Date: Jun. 24, 2021

(65) Prior Publication Data

US 2023/0002698 A1 Jan. 5, 2023

Related U.S. Application Data

(60) Provisional application No. 62/951,249, filed on Dec. 20, 2019.

(51) Int. Cl.

| | |
|---|---|
| ***C10M 169/06*** | (2006.01) |
| ***C10M 169/04*** | (2006.01) |
| *C10N 20/02* | (2006.01) |
| *C10N 20/04* | (2006.01) |
| *C10N 30/04* | (2006.01) |
| *C10N 30/10* | (2006.01) |

(52) U.S. Cl.

CPC ..... *C10M 169/041* (2013.01); *C10M 169/06* (2013.01); *C10M 2215/086* (2013.01); *C10N 2020/02* (2013.01); *C10N 2020/04* (2013.01); *C10N 2030/04* (2013.01); *C10N 2030/10* (2013.01)

(58) Field of Classification Search

CPC ..... C10M 169/041; C10M 169/06; C10M 2215/086; C10M 2203/1025; C10M 2205/0285; C10M 2215/28; C10M 169/04; C10N 2020/02; C10N 2020/04; C10N 2030/04; C10N 2030/10

USPC ..... 208/18

See application file for complete search history.

(56) References Cited

U.S. PATENT DOCUMENTS

| | | | | |
|---|---|---|---|---|
| 6,313,077 | B1 | 11/2001 | Stunnenberg | |
| 2012/0302481 | A1 | 11/2012 | Katayama | |
| 2013/0310289 | A1 | 11/2013 | Kazuhiro | |
| 2015/0322368 | A1 | 11/2015 | Patel | |
| 2015/0344805 | A1* | 12/2015 | Dance | C10M 157/04 508/293 |

FOREIGN PATENT DOCUMENTS

| | | | |
|---|---|---|---|
| CN | 101531944 | B | 5/2014 |
| CN | 103068955 | B | 4/2016 |
| EP | 2610331 | A1 | 3/2013 |
| EP | 3406694 | A1 | 11/2018 |
| JP | S5989397 | U | 6/1984 |
| JP | 2002501973 | A | 1/2002 |
| JP | 2008528709 | A | 7/2008 |
| JP | 2009215531 | A | 9/2009 |
| JP | 2012046555 | A | 3/2012 |
| JP | 2015160954 | A | 9/2015 |
| JP | 2017514983 | A | 6/2017 |
| JP | 2019178296 | A | 10/2019 |
| WO | 2019018326 | A1 | 1/2019 |

OTHER PUBLICATIONS

International Search Report, issued on Mar. 4, 2021, during the prosecution of International Application No. PCT/iB2020/061727, 3 pages.

Written Opinion of the International Searching Authority, issued on Mar. 4, 2021, during the prosecution of International Application No. PCT/IB2020/061727, 6 pages.

* cited by examiner

*Primary Examiner* — Prem C Singh
*Assistant Examiner* — Francis C Campanell

(57) ABSTRACT

Lubricating oil compositions are disclosed. The lubricating oil compositions include one or more base oils (A) containing one or more polyalphaolefin (PAO) base oils derived at least in part from a $C_{12}$ olefin. The lubricating oil compositions further include from about 65 wt. % to about 85 wt. %, based on the total weight of the lubricating oil composition, of one or more base oils (B) having a kinematic viscosity at 100° C. of from about 3.0 cSt to about 5.5 cSt; and from about 0.1 wt. % to about 10 wt. %, based on the total weight of the lubricating oil composition, of a succinimide dispersant.

14 Claims, No Drawings

LUBRICATING OIL COMPOSITIONS COMPRISING A POLYALPHAOLEFIN

FIELD OF THE INVENTION

This disclosure generally relates to lubricating oil compositions which contain one or more polyalphaolefin base oils. The lubricant compositions are effective at reducing oxidation and viscosity increase in the lubricating oil of an internal combustion engine.

BACKGROUND OF THE DISCLOSURE

The demand on engine lubricants has become more severe to cope with modern engine designs which have stronger anti-oxidation requirements. This has forced additive companies to develop robust engine oils with stronger antioxidant capabilities.

Engine oil is usually blended with various additives in order to satisfy various performance requirements. One well known way to increase fuel economy is to decrease the viscosity of the lubricating oil. Most internal combustion engine oils, which demonstrate excellent fuel economy performance, are usually formulated to be low viscosity oils with a viscosity index improver (VII) to reduce fluid friction from viscosity resistance under low temperature. In order to improve fuel efficiency, many original equipment manufacturers (OEM's) are looking at shifting to downsized turbo diesel (DE) and gasoline direct injection (GDI) engines for the improvement of fuel efficiency. The drawback to the move to lower viscosity oils with higher VII is an increase in oxidation and the formation of deposits. These are mainly derived from the partially burned fuel and fuel soot which, along with the engine oil, can adhere to the piston top, piston ring, as well as the engine combustion chamber surfaces.

Oxidation of engine oils negatively impacts the performance of the lubricating oils and result in reducing the performance life of the engine oil and damage to metal surfaces of the engine. Thus, reducing oxidation in lubricating engine oils is needed.

SUMMARY OF THE DISCLOSURE

In accordance with one aspect of the present disclosure, there is provided a lubricating oil composition which comprises:

(a) from about 6 wt. % to about 15 wt. %, based on the total weight of the lubricating oil composition, of one or more base oils (A) comprising one or more polyalphaolefin (PAO) base oils having a kinematic viscosity at 100° C. of from about 8.0 cSt to about 12 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant; and wherein base oil (A) is derived at least in part from a $C_{12}$ olefin and further wherein base oil A has a weight average molecular weight of from about 300 g/mol to about 1000 g/nol.

In accordance with a second aspect of the present disclosure, there is provided a method comprising lubricating an engine with a lubricating oil composition comprising:

(a) from about 6 wt. % to about 15 wt. %, based on the total weight of the lubricating oil composition, of one or more base oils (A) comprising one or more PAO base oils having a kinematic viscosity at 100° C. of from about 8.0 cSt to about 12 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant; and wherein base oil (A) is derived at least in part from a $C_{12}$ olefin and further wherein base oil A has a weight average molecular weight of from about 300 g/mol to about 1000 g/mol.

In accordance with a third aspect of the present disclosure, there is provided a use of a lubricating oil composition according in an internal combustion engine for reducing piston deposits, wherein the lubricating oil composition comprises:

(a) from about 6 wt. % to about 15 wt. %, based on the total weight of the lubricating oil composition, of one or more base oils (A) comprising one or more PAO base oils having a kinematic viscosity at 100° C. of from about 8.0 cSt to about 12 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %4, based on the total weight of the lubricating oil composition, of a succinimide dispersant;

wherein base oil (A) is derived at least in part from a $C_{12}$ olefin and further wherein base oil A has a weight average molecular weight of from about 300 g/mol to about 1000 g/mol.

In accordance with a fourth aspect of the present disclosure, there is provided a lubricating oil composition which comprises:

(a) from about 2 wt. % to about 10 wt. %, based on the total weight of the lubricating oil composition, of one or more base oils (A) comprising one or more PAO base oils having a kinematic viscosity at 100° C. of from about 30.0 cSt to about 50.0 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant;

wherein base oil (A) is derived at least in part from a $C_{12}$ olefin and wherein base oil A has a molecular weight of from 900 g/mol to 10,000 g/mol.

In accordance with a fifth aspect of the present disclosure, there is provided a method comprising lubricating an engine with a lubricating oil composition comprising:

(a) from about 2 wt. % to about 10 wt. %, based on the total weight of the lubricating oil composition, of one or more base oils (A) comprising one or more PAO base oils having a kinematic viscosity at 100° C. of from about 30.0 cSt to about 50.0 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt, and (c) from about 0.1 wt. % to about 10 wt. %, based on the total weight of the lubricating oil composition, of a succinimide dispersant;

wherein base oil (A) is derived at least in part from a $C_{12}$ olefin and wherein base oil A has a molecular weight of from 900 g/mol to 10,000 g/mol.

In accordance with a sixth aspect of the present disclosure, there is provided a use of a lubricating oil composition according in an internal combustion engine for reducing piston deposits, wherein the lubricating oil composition comprises:

(a) from about 2 wt. % to about 10 wt. %, based on the total weight of the lubricating oil composition, of one or more base oils (A) comprising one or more PAO base oils having a kinematic viscosity at 100° C. of from about 30.0 cSt to about 50.0 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant;

wherein base oil (A) is derived at least in part from a $C_{12}$ olefin and wherein base oil A has a molecular weight of from 900 g/mol to 10,000 g/mol.

DETAILED DESCRIPTION OF THE DISCLOSURE

While the invention is susceptible to various modifications and alternative forms, specific embodiments thereof are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about." it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

As used herein, the following terms have the following meanings, unless expressly stated to the contrary. In this specification, the following words and expressions, if and when used, have the meanings given below.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" or "oil free" refers to additive material that is not diluent or solvent.

All percentages reported am weight % on an active ingredient basis (i.e., without regard to carrier or diluent oil) unless otherwise stated.

The abbreviation "ppm" means parts per million by weight, based on the total weight of the lubricating oil composition.

Total base number (TBN) was determined in accordance with ASTM D2896.

Metal—The term "metal" refers to alkali metals, alkaline earth metals, or mixtures thereof.

High temperature high shear (HTHS) viscosity at 150° C. was determined in accordance with ASTM D4863.

Kinematic viscosity at 100° C. ($KV_{100}$) was determined in accordance with ASTM D445.

Cold Cranking Simulator (CCS) viscosity at −35° C. was determined in accordance with ASTM D5293.

All ASTM standards referred to herein are the most current versions as of the filing date of the present application.

In one illustrative embodiment, the present disclosure is directed to a lubricating oil composition comprising:

(a) from about 6 wt. % to about 15 wt. %, based on the total weight of the lubricating oil composition, of one or more base oils (A) comprising one or more PAO base oils having a kinematic viscosity at 100° C. of from about 8.0 cSt to about 12 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant.

In another illustrative embodiment, the present disclosure is further directed to a lubricating oil composition comprising:

(a) from about 2 wt. % to about 10 wt. %, based on the total weight of the lubricating oil composition, of one or more base oils (A) comprising one or more PAO base oils having a kinematic viscosity at 100° C. of from about 30.0 cSt to about 50.0 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant;

wherein base oil (A) is derived at least in part from a $C_{12}$ olefin and wherein base oil A has a molecular weight of from 900 g/mol to 10,000 g/mol.

Base Oil (A)

Base oil (A) for use in one aspect of an above-mentioned lubricating oil composition comprises one or more PAO base oils having a kinematic viscosity at 100° C. of from about 8.0 centistokes (cSt) to about 12 cSt. In one aspect, the one or more PAO base oils have a kinematic viscosity at 100° C. of about 8 cSt or greater, for example, about 9 or greater, about 10 or greater, or about 11 or greater. In some aspects, the one or more PAO base oils have a kinematic viscosity at 100° C. of from about 8.0 to about 12.0, or about 9 to about 12, or about 10 to about 12 cSt.

In one aspect, base oil A comprising the one or more PAO base oils having a kinematic viscosity at 100° C. of from about 8.0 cSt to about 12 cSt can have a weight average molecular weight of from about 300 g/mol to about 1000 g/mol. In other aspects, base oil A comprising the one or more PAO base oils having a kinematic viscosity at 100° C. of from about 8.0 cSt to about 12 cSt can have a weight average molecular weight of from about 400 to about 950, about 450 to about 900, about 500 to about 850, about 600 to about 800, about 650 to about 800, about 700 to about 800, about 725 to about 800, or about 725 to about 775 g/mol.

In one aspect, base oil A comprising the one or more PAO base oils having a kinematic viscosity at 100° C. of from about 8.0 cSt to about 12 cSt can have a number average molecular number (Mn) of from about 500 to about 900. In other aspects, base oil A comprising the one or more PAO base oils having a kinematic viscosity at 100° C. of from about 8.0 cSt to about 12 cSt can have a number average molecular number (Mn) of from about 600 to about 850, about 600 to about 825, about 650 to about 800, about 675 to about 775, or about 700 to about 750.

Base oil (A) for use in another aspect of an above-mentioned lubricating oil composition comprises one or more PAO base oils having a kinematic viscosity at 100° C. of from about 30.0 cSt to about 50.0 cSt. In one aspect, the one or more PAO base oils have a kinematic viscosity at 100° C. of more than about 30.0 cSt, for example, more than about 30.0, more than about 35.0, more than about 40.0, or more than about 45.0 cSt. In other aspects, the one or more PAO base oils have a kinematic viscosity at 100° C. of from about 30.0 to about 45.0 cSt. In other aspects, the one or more PAO base oils have a kinematic viscosity at 100° C. of from about 35.0 to about 45.0. In other aspects, the one or more PAO base oils have a kinematic viscosity at 100° C. of from about 35.0 to about 42.0 cSt. In other aspects, the one or more PAO base oils have a kinematic viscosity at 100° C. of from about 37.0 to about 42.0 cSt.

In one aspect, base oil A comprising the one or more PAO base oils having a kinematic viscosity at 100° C. of from about 30.0 cSt to about 50.0 cSt can have a weight average molecular weight of from about 900 g/mol to about 10.000 g/mol. In another aspect, base oil A comprising the one or more PAO base oils having a kinematic viscosity at 100° C. of from about 30.0 cSt to about 50.0 cSt can have a weight average molecular weight of from about 1500 g/mol to about 3500 g/mol. In another aspect, base oil A comprising the one or more PAO base oils having a kinematic viscosity at 100° C. of from about 30.0 cSt to about 50.0 cSt can have a weight average molecular weight of from about 2000 to about 3200, about 2200 to about 3100, about 2400 to about 3000, about 2500 to about 3000, about 2600 to about 2900, or about 2700 to about 2800.

In one aspect, base oil A comprising the one or more PAO base oils having a kinematic viscosity at 100° C. of from about 30.0 cSt to about 50.0 cSt can have a number average molecular number (Mn) of from about 1500 to about 2700. In other aspects, base oil A comprising the one or more PAO base oils having a kinematic viscosity at 100° C. of from about 30.0 cSt to about 50.0 cSt can have a number average molecular number (Mn) of from about 1700 to about 2500, about 1900 to about 2400, about 2000 to about 2300, about 2050 to about 2250, or about 2100 to about 2200.

In one aspect, the one or more PAOs for use in the foregoing base oils A comprise oligomers of alpha-olefin having from 6 to 14 carbon atoms, or from 7 to 13 carbon atoms, or from 8 to 12 carbon atoms, or from 9 to 12 carbon atoms, or from 10 to 12 carbon atoms. In other aspects, the PAO comprises oligomers of alpha-olefin having 8, 9, 10, and/or 12 carbon atoms. In one aspect, the PAO comprises oligomers which are derived, at least in part, from $C_{12}$ alpha-olefins.

In one aspect, the forgoing oligomers of alpha-olefins, derived at least in part from $C_{12}$ olefins, are dimers, trimers, tetramers, pentamers, etc. of $C_6$ to $C_{14}$ (or $C_7$ to $C_{13}$, or $C_8$ to $C_{12}$, or $C_9$ to $C_{12}$, $C_{10}$ to $C_{12}$, or $C_{12}$) branched or linear alpha-olefins. Suitable alpha-olefins include, for example, 1-hexane, 1-heptene, 1-octene, 1-nonene, 1-decene, 1-undecene, 1-dodecene, 1-tridecene, 1-tetradecene, and blends thereof.

In one aspect, the one or more PAOs comprise oligomers of a single alpha-olefin olefin species. In another aspect, the PAO comprises oligomers of a mixture of alpha-olefin olefin species (i.e., involving two or more alpha-olefin species), each alpha-olefin having a carbon number of 6 to 14 (or 6 to 14, or 6 to 12, or 8 to 12). In one aspect, the PAO comprises oligomers of mixed alpha-olefins (i.e., involving two or more alpha-olefin species) where the weighted average carbon number for the alpha-olefin mixture is 6 to 14.

In one aspect, the one or more PAOs comprise oligomers derived, at least in part, from $C_{12}$ linear alpha-olefin olefins. In another aspect, the one or more PAOs comprise oligomers derived, at least in part, from $C_{12}$ branched alpha-olefin olefins.

In one aspect, the one or more PAO base oils have a Flash Point of about 225° C. or more, for example, about 240° C. or more, about 250° C. or more, about 260° C. or more, about 270° C. or more, about 280° C. or more, or about 290° C. or more. In another aspect, the PAO or mixture of PAOs has a Flash Point of about 240° C. to about 290° C., or about 250° C. to about 290° C., or about 255° C. to about 290° C., or about 260° C. to about 285° C.

In one aspect, the one or more PAO base oils have a Pour Point of less than about −15° C., or less than −20° C., or less than −25° C., or less than −30° C., or less than −35° C., or less than 40° C. In another aspect, the PAO or mixture of PAOs has a Pour Point of from about −20° C. to about −75° C., or from about −25° C. to about −65° C., or from about −30° C. to about −60° C.

In one aspect, the one or more PAO base oils have a Viscosity Index of about 125 or more, for example, about 130 or more, about 140 or more, about 150 or more, about 160 or more, about 170 or more, about 180 or more, about 190 or more, or about 200 or more. In another aspect, the PAO or mixture of PAOs has a Viscosity Index of about 125 to about 190, about 130 to about 180, or about 135 to about 175. In some aspects, the PAO or mixture of PAOs has a Viscosity Index of about 130 to about 150. In some aspects, the PAO or mixture of PAOs has a Viscosity Index of about 135 to about 150. In some aspects, the PAO or mixture of PAOs has a Viscosity Index of about 140 to about 155.

In one aspect, the one or more PAO base oils have a Noack Volatility of from about 0.4 to about 6.5 wt. %. In other aspects, the PAO or mixture of PAOs has a Noack Volatility of about 0.6 to about 6.5 wt. %. In other aspects, the PAO or mixture of PAOs has a Noack Volatility of from about 0.8 to about 6.5 wt. % the PAO or mixture of PAOs has a Noack Volatility of from about 1.0 to about 6.0 wt. %, or about 1.0 to about 5.0 wt. %, or about 1.0 to about 4.5 wt. %, or about 1.0 to about 4.2 wt. %, or about 1.0 to about 4.0 wt. %

In one aspect, the one or more base oils A having a kinematic viscosity at 100° C. of from about 8.0 centistokes (cSt) to about 12 cSt are present in the lubricating oil composition in an amount ranging from about 6.0 wt. % to about 15 wt. %, based on the total weight of the lubricating oil composition. In another aspect, the one or more base oils A are present in the lubricating oil composition in an amount ranging from about 6.0 wt. % to about 12 wt. %, based on the total weight of the lubricating oil composition. In another aspect, the one or more base oils A are present in the lubricating oil composition in an amount ranging from about 6.0 wt. % to about 11 wt. %, based on the total weight of the lubricating oil composition. In another aspect, one or more base oils A are present in the lubricating oil composition in an amount ranging from about or from about 6.0 wt. % to about 10 wt. % based on the total weight of the lubricating oil composition.

In one aspect, one or more PAO base oils having a kinematic viscosity at 100° C. of from about 30.0 cSt to about 50.0 cSt are present from about 2.0 to about 10 wt. %, based on the total weight of the lubricating oil composition. In another aspect, the one or more base oils A are present in the lubricating oil composition in an amount ranging from about 2.0 to about 8 wt. %, based on the total weight of the lubricating oil composition. In another aspect, the one or more base oils A are present in the lubricating oil composition in an amount ranging from about 2.0 to about 6 wt. %, based on the total weight of the lubricating oil composition. In another aspect, the one or more base oils A are present in the lubricating oil composition in an amount ranging from about 2.5 to about 5 wt. %, based on the total weight of the lubricating oil composition Base Oil (B)

Base oil (B) for use in the above-mentioned lubricating oil compositions include one or more base oils (B) having a kinematic viscosity at 100° C. of from about 3.0 cSt to about 5.5 cSt. Suitable base oils having a kinematic viscosity at 100° C. of from about 3.0 cSt to about 5.5 cSt include, for example, one or more Group III base oils, one or more Group IV base oils and mixtures thereof.

A Group III base oil can be any petroleum derived base oil of lubricating viscosity as defined in API Publication 1509, 14th Edition, Addendum I, December 1998 as long as it has a kinematic viscosity at 100° C. of from about 3.0 cSt to about 5.5 cSt. API guidelines define a base stock as a lubricant component that may be manufactured using a variety of different processes. In general, Group III base oils generally refer to a petroleum derived lubricating base oil having less than 300 ppm sulfur, a saturates content greater than 90 weight percent, and a VI of 120 or greater. In one aspect, the Group III base oil contains at least about 95% by weight saturated hydrocarbons. In another aspect, the Group III base oil contains at least about 99% by weight saturated hydrocarbons. The Group III base oils are described below under the heading "Oil of Lubricating Viscosity", and their properties for base oil B are summarized in Table 1.

Group IV base oils are polyalphaolefins. In one aspect, the one or more Group IV PAO base oil can be any PAO that meets the foregoing Kv requirements at 100° C. In general, the one or more PAOs used as the base oil (B) component may be selected from any of the olefin oligomer oils used in lubricants. For example, the PAO oils may be derived from monomers having from about 4 to about 30 carbon atoms or from about 10 to about 28 carbon atoms. Examples of useful PAOs include those derived from octene, decene, mixtures thereof and the like.

In one aspect, base oil (B) is a single Group III or Group IV base oil. In another aspect, base oil (B) is a mixture of Group III base oils or Group IV base oils or of Group III base oils and Group IV base oils.

Dispersants

Dispersants maintain in suspension materials resulting from oxidation during engine operation that are insoluble in oil, thus preventing sludge flocculation and precipitation or deposition on metal parts. Dispersants useful herein include nitrogen-containing, ashless (metal-free) dispersants known to effective to reduce formation of deposits upon use in gasoline and diesel engines.

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also suitable are condensation products of polyamines and hydrocarbyl-substituted phenyl acids. Mixtures of these dispersants can also be used.

Basic nitrogen-containing ashless dispersants are well-known lubricating oil additives and methods for their preparation are extensively described in the patent literature. Preferred dispersants are the alkenyl succinimides and succinamides where the alkenyl-substituent is a long-chain of preferably greater than 40 carbon atoms. These materials are readily made by reacting a hydrocarbyl-substituted dicarboxylic acid material with a molecule containing amine functionality. Examples of suitable amines are polyamines such as polyalkylene polyamines, hydroxy-substituted polyamines and polyoxyalkylene polyamines.

Particularly preferred ashless dispersants are the polyisobutenyl succinimides formed from polyisobutenyl succinic anhydride and a polyalkylene polyamine such as a polyethylene polyamine of formula:

$$NH_2(CH_2CH_2NH)_2H$$

wherein z is 1 to 11. The polyisobutenyl group is derived from polyisobutene and preferably has a number average molecular weight (Mn) in a range of 700 to 3000 Daltons (e.g., 900 to 2500 Daltons). For example, the polyisobutenyl succinimide may be a bis-succinimide derived from a polyisobutenyl group having a $M_n$ of about 900 to about 3000 Daltons. In one aspect, the bis-succinimide may be derived from a polyisobutenyl group having a $M_n$ of about 900 to about 2500 Daltons. In one aspect, the bis-succinimide may be derived from a polyisobutenyl group having a $M_n$ of about 1300 to about 2500 Daltons. In one aspect, the bis-succinimide may be derived from a polyisobutenyl group having a $M_n$ of 2000 to 2500 Daltons. In another aspect, the bis-succinimide may be derived from a polyisobutenyl group having a $M_n$ of 2300 Daltons.

As is known in the art, the dispersants may be post-treated with, for example, a boronating agent or a cyclic carbonate.

In one aspect, the bis-succinimide is a borated bis-succinimide derived from a polyisobutenyl group having a $M_n$ of 1000 to 2500 Daltons. In another aspect, the bis-succinimide is a borated bis-succinimide derived from a polyisobutenyl group having a $M_n$ of 1300 Daltons.

Nitrogen-containing ashless (metal-free) dispersants are basic, and contribute to the TBN of a lubricating oil composition to which they are added, without introducing additional sulfated ash.

In one aspect, the one or more dispersants may be present in an amount ranging from about 0.1 to about 10 wt. % (e.g., about 0.5 to about 8, about 0.7 to about 7, about 0.7 to about 6, about 0.7 to about 6, about 0.7 to about 5, about 0.7 to about 4 wt. %), based on an actives level of the lubricating oil composition.

Nitrogen from the dispersants is present from greater than about 0.0050 to about 0.30 wt. % (e.g., greater than about 0.0050 to about 0.10 wt. %, about 0.0050 to about 0.080 wt. %, about 0.0050 to about 0.060 wt. %, about 0.0050 to about 0.050 wt. %, about 0.0050 to about 0.040 wt. %, about 0.0050 to about 0.030 wt. %) based on the weight of the dispersants in the finished oil.

Detergents

Detergents that may be used include oil-soluble overbased sulfonate, non-sulfur containing phenate, sulfurized phenates, salixarate, salicylate, saligenin, complex detergents and naphthenate detergents and other oil-soluble alkylhydroxybenzoates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

Overbased metal detergents are generally produced by carbonating a mixture of hydrocarbons, detergent acid, for example: sulfonic acid, alkylhydroxybenzoate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Overbased detergents may be low overbased. e.g., an overbased salt having a TBN below 100 on an actives basis. In one aspect, the TBN of a low overbased salt may be from about 30 to about 100. In another aspect, the TBN of a low overbased salt may be from about 30 to about 80. Overbased detergents may be medium overbased, e.g., an overbased salt having a TBN from about 100 to about 250 on an actives basis. In one aspect, the TBN of a medium overbased salt may be from about 100 to about 200. In another aspect, the TBN of a medium overbased salt may be from about 125 to about 175. Overbased detergents may be high overbased, e.g., an overbased salt having a TBN above 250 on an actives basis. In one aspect, the TBN of a high overbased salt may be from about 250 to about 800 on an actives basis.

In one aspect, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms, preferably about 16 to 30 carbon atoms, and more preferably 20-24 carbon atoms per alkyl substituted aromatic moiety.

Metal salts of phenols and sulfurized phenols, which are sulfurized phenate detergents, are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds m which 2 or more phenols are bridged by sulfur containing bridges.

Additional details regarding the general preparation of sulfurized phenates can be found in, for example, U.S. Pat. Nos. 2,680,096; 3,178,368, 3,801,507, and 8,580,717 the contents of which are incorporated herein by reference.

Generally, the amount of the detergent can be from about 0.001 wt. % to about 50 wt. %, or from about 0.05 wt. % to about 25 wt. %, or from about 0.1 wt. % to about 20 wt. %, or from about 0.01 to 15 wt. % based on the total weight of the lubricating oil composition.

Antiwear Agents

The lubricating oil composition disclosed herein can comprise one or more antiwear agents. Antiwear agents reduce wear of metal parts. Suitable anti-wear agents include dihydrocarbyl dithiophosphate metal salts such as zinc dihydrocarbyl dithiophosphates (ZDDP) of formula (Formula 1):

$$Zn[S—P(=S)(OR^1)(OR^2)]_2 \qquad \text{Formula 1,}$$

wherein $R^1$ and $R^2$ may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as $R^1$ and $R^2$ groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e. $R^1+R^2$) will be at least 5. The zinc dihydrocarbyl dithiophosphate can therefore comprise zinc dialkyl dithiophosphates. The zinc dialkyl dithiophosphate is a primary, secondary zinc dialkyl dithiophosphate, or a combination thereof. ZDDP may be present at 3 wt. % or less (e.g., 0.1 to 1.5 wt. %, or 0.5 to 1.0 wt. %) of the lubricating oil composition. In one embodiment, the lubricating oil composition containing the magnesium salicylate detergent described herein further comprises an antioxidant compound. In one embodiment, the antioxidant is a diphenylamine antioxidant. In another embodiment, the antioxidant is a hindered phenol antioxidant. In yet another embodiment, the antioxidant is a combination of a diphenylamine antioxidant and a hindered phenol antioxidant.

Antioxidants

The lubricating oil composition disclosed herein can comprise one or more antioxidants. Antioxidants reduce the tendency of mineral oils during to deteriorate during service. Oxidative deterioration can be evidenced by sludge in the lubricant, varnish-like deposits on the metal surfaces, and by viscosity growth. Suitable antioxidants include hindered phenols, aromatic amines, and sulfurized alkylphenols and alkali and alkaline earth metals salts thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group.

Examples of suitable hindered phenol antioxidants include 2,6-di-tert-butylphenol; 4-methyl-2,6-di-tert-butylphenol; 4-ethyl-2,6-di-tert-butylphenol; 4-propyl-2,6-di-tert-butylphenol; 4-butyl-2,6-di-tert-butylphenol; and 4-dodecyl-2,6-di-tert-butylphenol. Other useful hindered phenol antioxidants include 2,6-di-alkyl-phenolic propionic ester derivatives such as IRGANOX® L-135 from Ciba and bis-phenolic antioxidants such as 4,4'-bis(2,6-di-tert-butylphenol) and 4,4'-methylenebis(2,6-di-tert-butylphenol).

Typical aromatic amine antioxidants have at least two aromatic groups attached directly to one amine nitrogen. Typical aromatic amine antioxidants have alkyl substituent groups of at least 6 carbon atoms. Particular examples of aromatic amine antioxidants useful herein include 4,4'-dioctyldiphenylamine, 4,4'-dinonyldiphenylamine, N-phenyl-1-naphthylamine, N-(4-tert-octyphenyl)-1-naphthylamine, and N-(4-octylphenyl)-1-naphthylamine. Antioxidants may be present at 0.01 to 5 wt. % (e.g., 0.1 to 2 wt. %) of the lubricating oil composition.

Foam Inhibitors

The lubricating oil composition disclosed herein can comprise one or more foam inhibitors that can break up foams in oils. Non-limiting examples of suitable foam inhibitors or anti-foam inhibitors include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof.

Additional Co-Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 100 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

Additional Base Oils of Lubricating Viscosity

If desired, the lubricating oil compositions of the present disclosure can contain minor mounts of other base oil components. The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes); alkylbenzenes (e.g., dodecylbenzenes, tetradecylbenzenes, dinonylbenzenes, di(2-ethylhexyl)benzenes; polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentacrythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt. and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Lubricating Oil Compositions

In general, the level of sulfur in the lubricating oil compositions of the present invention is less than or equal to about 0.7 wt. %, based on the total weight of the lubricating oil composition. e.g., a level of sulfur of about 0.01 wt. % to about 0.70 wt. %, 0.01 to 0.6 wt. %, 0.01 to 0.5 wt. %, 0.01 to 0.4 wt. %, 0.01 to 0.3 wt. %, 0.01 to 0.2 wt. %, 0.01 wt. % to 0.10 wt. %. In one embodiment, the level of sulfur in the lubricating oil compositions of the present invention is less than or equal to about 0.60 wt. %, less than or equal to about 0.50 wt. %, less than or equal to about 0.40 wt. %, less than or equal to about 0.30 wt. %, less than or equal to about 0.20 wt. %, less than or equal to about 0.10 wt. % based on the total weight of the lubricating oil composition.

In one embodiment, the level of phosphorus in the lubricating oil compositions of the present invention is less than or equal to about 0.12 wt. %, based on the total weight of the lubricating oil composition, e.g., a level of phosphorus of about 0.01 wt. % to about 0.12 wt. %. In one embodiment, the level of phosphorus in the lubricating oil compositions of the present invention is less than or equal to about 0.11 wt. %, based on the total weight of the lubricating oil composition, e.g., a level of phosphorus of about 0.01 wt. % to about 0.11 wt. %. In one embodiment, the level of phosphorus in the lubricating oil compositions of the present invention is less than or equal to about 0.10 wt. %, based on the total weight of the lubricating oil composition, e.g., a level of phosphorus of about 0.01 wt. % to about 0.10 wt. %. In one embodiment, the level of phosphorus in the lubricating oil compositions of the present invention is less than or equal to about 0.09 wt. %, based on the total weight of the lubricating oil composition, e.g., a level of phosphorus of about 0.01 wt. % to about 0.09 wt. %. In one embodiment, the levels of phosphorus in the lubricating oil compositions of the present invention is less than or equal to about 0.08 wt. %, based on the total weight of the lubricating oil composition, e.g., a level of phosphorus of about 0.01 wt. % to about 0.08 wt. % In one embodiment, the level of phosphorus in the lubricating oil compositions of the present invention is less than or equal to about 0.07 wt. %, based on the total weight of the lubricating oil composition, e.g., a level of phosphorus of about 0.01 wt. % to about 0.07 wt. %. In one embodiment, the level of phosphorus in the lubricating oil compositions of the present invention is less than or equal to about 0.05 wt. %, based on the total weight of the lubricating oil composition. e.g., a level of phosphorus of about 0.01 wt. % to about 0.05 wt. %.

In one embodiment, the level of sulfated ash produced by the lubricating oil compositions of the present invention is less than or equal to about 1.60 wt. % as determined by ASTM D 874. e.g., a level of sulfated ash of from about 0.10 to about 1.60 wt. % as determined by ASTM D 874. In one embodiment, the level of sulfated ash produced by the lubricating oil compositions of the present invention is less than or equal to about 1.00 wt. % as determined by ASTM D 874, e.g., a level of sulfated ash of from about 0.10 to about 1.00 wt. % as determined by ASTM D 874. In one embodiment, the level of sulfated ash produced by the lubricating oil compositions of the present invention is less than or equal to about 0.80 wt. % as determined by ASTM D 874, e.g., a level of sulfated ash of from about 0.10 to about 0.80 wt. % as determined by ASTM D 874. In one embodiment, the level of sulfated ash produced by the lubricating oil compositions of the present invention is less than or equal to about 0.60 wt. % as determined by ASTM D 874. e.g., a level of sulfated ash of from about 0.10 to about 0.60 wt. % as determined by ASTM D 874.

In one aspect, the high temperature shear (HTHS) viscosity of the lubricating oil composition is from greater than 1.7 to less than 3.7 mPa·s and the NOACK loss is from 10 to 20 wt. %. In other aspects, the high temperature shear (HTHS) viscosity of the lubricating oil composition is from greater than 1.7 to less than 3.7 mPa·s and the NOACK loss is from 10 to 15, or from 10 to 12 wt. %.

In certain embodiments, the present disclosure provides lubricating oil compositions suitable for reducing friction in passenger car internal combustion engines, particularly spark-ignited, direct injection and/or port fuel injection engines. In certain embodiments, the engine may be coupled to an electric motor/battery system in a hybrid vehicle (e.g., a port fuel injection spark ignition engine coupled to an electric motor/battery system in a hybrid vehicle). In certain embodiments, the present disclosure provides lubricating oil compositions suitable for reducing friction in heavy duty diesel internal combustion engines.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

The following examples are intended for illustrative purposes only and do not limit in any way the scope of the present disclosure.

The lubricating oil compositions of Examples 1-8, and Comparative Examples 1-4 were prepared and tested for piston cleanliness and tendency to piston ring sticking according to the Volkswagen Turbocharged DI test, a European passenger car diesel engine test (CEC-L-78-T-99), which is part of the ACEA A/B and C specifications promulgated by the European Automobile Manufacturers Association in 2004. This test was used to simulate repeated cycles of high-speed operation followed by idling. A Volkswagen 1.9 liter, inline, four-cylinder turbocharged direct injection automotive diesel engine (VW TDi) was mounted on an engine dynamometer stand A 54-hour, 2-phased procedure that cycles between 30 minutes of 40° C. oil sump at idle and 150 minutes of 145° C. oil sump at full power (4150 rpm) was carried out without interim oil top-ups. After the procedure, the pistons were rated for carbon and lacquer deposits, as well for groove carbon filling. The piston rings were evaluated for ring sticking. The results are set forth below in Table 2.

Example 1

A 0W-12 viscosity grade fully formulated lubricating oil composition was prepared comprising about 6.0 wt. % of a Group TV base oil (PAO 10, 10 cSt at 100° C., derived from a $C_8$-$C_{12}$ olefin, having a weight average molecular weight of from about 760 g/mol and a number average molecular number of about 720), 74.9 wt. % Group IV base oil (3.6 cSt at 100'C), about 6.0 wt. % of a Group III base oil (2.91 cSt at 100° C.), about 3.2 wt. % based on actives of a bis-succinimide based dispersant having a polyisobutyl group with a number average molecular weight of approximately 2300, and typical amounts of detergents, phosphorous anti-wear agent, antioxidant, friction modifier, foam inhibitor, viscosity index improver, pour point depressant and diluent oil.

Example 2

A 0W-12 viscosity grade fully formulated lubricating oil composition was prepared comprising about 8.0 wt. % of a Group IV base oil (PAO 10, 10 cSt at 100° C., derived from a $C_8$-$C_{12}$ olefin, having a weight average molecular weight of from about 760 g/mol and a number average molecular number of about 720), 72.9 wt. % Group IV base oil (3.6 cSt at 100° C.), about 5.3 wt. % of a Group III base oil (2.91 CSt at 100° C.), about 3.2 wt. % based on actives of a bis-succinimide based dispersant having a polyisobutyl group with a number average molecular weight of approximately 2300, and typical amounts of detergents, phosphorous anti-wear agent, antioxidant, friction modifier, foam inhibitor, viscosity index improver, pour point depressant, and diluent oil.

Example 3

A 0W-12 viscosity grade fully formulated lubricating oil composition was prepared comprising about 10.0 wt. % of a Group IV base oil (PAO 10, 10 cSt at 100° C. derived from a $C_8$-$C_{12}$ olefin, having a weight average molecular weight of from about 760 g/mol and a number average molecular number of about 720), 70.9 wt. % Group IV base oil (3.6 cSt at 100° C.), about 5.3 wt. % of a Group III base oil (2.91 CSt at 100° C.), about 3.2 wt. % based on actives of a bis-succinimide based dispersant having a polyisobutyl group with a number average molecular weight of approximately 2300, and typical amounts of detergents, phosphorous anti-wear agent, antioxidant, friction modifier, foam inhibitor, viscosity index improver, pour point depressant, and diluent oil.

Comparative Example 1

A 0W-12 viscosity grade fully formulated lubricating oil composition was prepared comprising about 78.7 wt. % Group IV base oil (3.6 cSt at 100° C.), about 5.0 wt. % of a Group III base oil (2.91 CSt at 100° C.), about 3.2 wt. % based on actives of a bis-succinimide based dispersant having a polyisobutyl group with a number average molecular weight of approximately 2300, and typical amounts of detergents, phosphorous antiwear agent, antioxidant, friction modifier, foam inhibitor, viscosity index improver, pour point depressant, and diluent oil.

Example 4

A 5W-40 viscosity grade fully formulated lubricating oil composition was prepared comprising about 10.0 wt. % of a Group IV base oil (PAO 10, 10 cSt at 100° C., derived from a $C_8$-$C_{12}$ olefin, having a weight average molecular weight of from about 760 g/mol and a number average molecular number of about 720), 35.4 wt. % Group III base oil (4.21 cSt at 100° C.), about 31.4 wt. % of a Group III base oil (6.36 CSt at 100° C.), about 2.9 wt. % based on actives of a bis-succinimide based dispersant having a polyisobutyl group with a number average molecular weight of approximately 2300, 0.79 wt. % based on actives of a borated bis-succinimide having a polyisobutyl group with a number average molecular weight of approximately 1300, and typical amounts of detergents, phosphorous antiwear agent, antioxidant, friction modifier, foam inhibitor, viscosity index improver, pour point depressant, and diluent oil.

Comparative Example 2

A 5W-40 viscosity grade fully formulated lubricating oil composition was prepared comprising about 33.3 wt. % Group III base oil (4.21 cSt at 100° C.), about 43.1 wt. % of a Group III base oil (6.36 CSt at 100° C.), about 2.9 wt. % based on actives of a bi-succinimide based dispersant having a polyisobutyl group with a number average molecular weight of approximately 2300, 0.7) wt. % based on actives of a borated bis-succinimide having a polyisobutyl group with a number average molecular weight of approximately 1300, and typical amounts of detergents, phosphorous antiwear agent, antioxidant, friction modifier, foam inhibitor, viscosity index improver, pour point depressant, and diluent oil.

Example 5

A 0W-20 viscosity grade fully formulated lubricating oil composition was prepared comprising about 10.0 wt. % of a Group IV base oil (PAO 10, 10 cSt at 100° C., derived from a $C_8$-$C_{12}$ olefin, having a weight average molecular weight of from about 760 g/mol and a number average molecular number of about 720), 68.8 wt. % Group III base oil (4.18 cSt at 100° C.), about 5.0 wt. % of a Group III base oil (6.36 CSt at 100° C.), about 2.1 wt. % based on actives of a bis-succinimide based dispersant having a polyisobutyl group with a number average molecular weight of approximately 2300, 2.0 wt. % based on actives of a borated bis-succinimide having a polyisobutyl group with a number average molecular weight of approximately 1300, and typical amounts of detergents, phosphorous antiwear agent, antioxidant friction modifier, foam inhibitor, viscosity index improver, pour point depressant, and diluent oil.

Example 6

A 0W-20 viscosity grade fully formulated lubricating oil composition was prepared comprising about 9.9 wt. % of a Group IV base oil (PAO 10, 10 cSt at 100° C., derived from a $C_8$-$C_{12}$ olefin, having a weight average molecular weight of from about 760 g/mol and a number average molecular number of about 720), 73.2 wt. % Group III base oil (4.0 cSt at 100° C.), about 3.4 wt. % based on actives of a bis-succinimide based dispersant having a polyisobutyl group with a number average molecular weight of approximately 2300, and typical amounts of detergents, phosphorous antiwear agent, antioxidant, friction modifier, foam inhibitor, viscosity index improver, pour point depressant, and diluent oil.

Comparative Example 3

A 0W-20 viscosity grade fully formulated lubricating oil composition was prepared comprising about 10.0 wt. % of a Group IV base oil (PAO 8, 7.95 cSt at 100° C., derived from a $C_{10}$ olefin, which is a mixture of trimers, tetramers, pentamers, and higher and not including a $C_{10}$ olefin), 73.1 wt. % Group III base oil (4.0 cSt at 100° C.), about 2.9 wt. % based on actives of a bis-succinimide based dispersant having a polyisobutyl group with a number average molecular weight of approximately 2300, and typical amounts of detergents, phosphorous antiwear agent, antioxidant, friction modifier, foam inhibitor, viscosity index improver, pour point depressant and diluent oil.

Example 7

A 0W-20 viscosity grade fully formulated lubricating oil composition was prepared comprising about 10.0 wt. % of a Group IV base oil (PAO 9, 9 cSt at 100° C., derived from a $C_{12}$ olefin), 73.1 wt. % Group III base oil (4.0 cSt at 100'C), about 3.4 wt. % based on actives of a bis-succinimide based dispersant having a polyisobutyl group with a number average molecular weight of approximately 2300, and typical amounts of detergents, phosphorous antiwear agent, antioxidant, friction modifier, foam inhibitor, viscosity index improver, pour point depressant, and diluent oil.

Example 8

A 0W-20 viscosity grade fully formulated lubricating oil composition was prepared comprising about 4.0 wt. % of a Group IV base oil (PAO 40, 39 cSt at 100° C., derived from a $C_9$-$C_{12}$ olefin, having a weight average molecular weight of 2768 g/mol and a number average molecular number of about 2188), 79.1 wt. % Group III base oil (4.0 cSt at 100° C.), about 3.4 wt. % based on actives of a bis-succinimide based dispersant having a polyisobutyl group with a number average molecular weight of approximately 2300, and typical amounts of detergents, phosphorous antiwear agent antioxidant, friction modifier, foam inhibitor, viscosity index improver, pour point depressant, and diluent oil.

Comparative Example 4

A 0W-20 viscosity grade fully formulated lubricating oil composition was prepared comprising about 4.0 wt. % of a Group IV base oil (PAO 40, 40 cSt, derived from a $C_8$ olefin), 79.4 wt. % Group III base oil (4.0 cSt at 100° C.), about 3.4 wt. % based on actives of a bis-succinimide based dispersant having a polyisobutyl group with a number average molecular weight of approximately 2300, and typical amounts of detergents, phosphorous antiwear agent, antioxidant, friction modifier, foam inhibitor, viscosity index improver, pour point depressant, and diluent oil

TABLE 2

| Test type: VWTDI2 | | | | | |
|---|---|---|---|---|---|
| Measurements | Ex. 1 | Ex. 2 | Ex. 3 | Comp. Ex. 1 | Ex. 4 |
| Inspection | 54 hr | 54 hr | 54 hr | 54 hr | 54 hr |
| Piston Merit Avg | 63 | 66 | 66 | 54 | 65 |
| Reference RL206 Piston Merit Avg | 66 | 66 | 65 | 66 | 64 |
| Ring Sticking Avg, of all 8 rings, ASF | 0 | 0 | 0 | 0 | 0 |
| Max for any 1st ring, ASF | 0 | 0 | 0 | 0 | 0 |
| Max for any 2nd ring, ASF | 0 | 0 | 0 | 0 | 0 |
| Pass/Fail | Fail C3 | Pass VW | Pass VW | Fail C3 | Pass VW |

| Measurements | Comp. Ex. 2 | Ex. 5 | Comp. Ex. 3 | Ex. 6 | Ex. 7 | Ex. 8 | Comp. Ex. 4 |
|---|---|---|---|---|---|---|---|
| Inspection | 54 hr | 54 hr | 54 hr | 54 hr | 54 hr | 54 hr | 54 hr |
| Piston Merit Avg | 59 | 66 | 57 | 68 | 67 | 66 | 57 |
| Reference RL206 Piston Merit Avg | 66 | 66 | — | 65 | — | — | — |
| Ring Sticking Avg, of all 8 rings, ASF | 0 | 0 | 0 | 0 | 0 | 0 | 0 |
| Max for any 1st ring, ASF | 0 | 0 | 0 | 0 | 0 | 0 | 0 |
| Max for any 2nd ring, ASF | 0 | 0 | 0 | 0 | 0 | 0 | 0 |
| Pass/Fail | Fail C3 | Pass VW | Fail C3 | Pass VW | Pass VW | Pass VW | Fail C3 |

The pass/fail score according to ACEA standards B4, B5, C3, and VW limits are listed in the following Table 3.

TABLE 3

| | ACEA A3/B4 limits | ACEA A5/B5 limits | ACEA C3 limits | VW 504/507 limits |
|---|---|---|---|---|
| Piston Merit, Avg | ≥RL206 | (≥RL206) | (≥RL206) | (≥Avg, RL206 + std) |
| Ring Sticking Avg, of all 8 rings, ASF | <=1.0 | <=1.0 | <=1.0 | <=1.0 |
| Max for any 1st ring, ASF | ≤1.0 | ≤1.0 | ≤1.0 | ≤1.0 |
| Max for any 2nd ring, ASF | ≤0.0 | ≤0.0 | ≤0.0 | ≤0.0 |
| TBN at EOT | >=6.0 | >=4.0 | Report | Report |
| TAN at EOT | Report | Report | Report | Report |

It will be understood that various modifications may be made to the embodiments disclosed herein. Therefore, the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising:

(a) from about 6 wt. % to about 15 wt. %, based on the total weight of the lubricating oil composition, of one or more base oils (A) comprising one or more polyalphaolefin (PAO) base oils having a kinematic viscosity at 10° C. of from about 8.0 cSt to about 12 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant;

wherein base oil (A) is derived at least in part from a $C_{12}$ olefin and further wherein base oil A has a weight average molecular weight of from about 300 g/mol to about 1000 g/mol.

2. The lubricating oil composition of claim 1, wherein the one or more PAO base oils are derived from a $C_6$ to $C_{14}$ alpha olefin.

3. The lubricating oil composition of claim 1, comprising from about 8 wt. % to about 12 wt. %, based on the total weight of the lubricating oil composition, of the one or more base oils (A).

4. The lubricating oil composition of claim 1, wherein the one or mom base oils (B) comprise one or more Group III base oils, one or more Group IV base oils or mixtures thereof.

5. The lubricating oil composition of claim 1, wherein the succinimide dispersant is derived from a polyalkyene group having a number average molecular weight of from about 1300 to about 2500 Daltons.

6. The lubricating oil composition of claim 1, comprising about 0.7 to about 5 wt. %, based on the total weight of the lubricating oil composition, of the succinimide dispersant.

7. The lubricating oil composition of claim 1, further comprising one or more lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, and mixtures thereof.

8. A method for reducing deposits in an internal combustion engine, the method comprising supplying a lubricating oil composition comprising:

(a) from about 6 wt. % to about 15 wt. %, based on the total weight of the lubricating oil composition, of one or more base oils (A) comprising one or more polyalphaolefin (PAO) base oils having a kinematic viscosity at 100° C. of from about 8.0 cSt to about 12 cSt;

(b) from about 65 wt. % to about 85 wt. %, based on the total weight of the lubricating oil composition, of one or more base oils (B) having a kinematic viscosity at 100° C. of from about 3.0 cSt to about 5.5 cSt; and (c) from about 0.1 wt. % to about 10 wt. %, based on the total weight of the lubricating oil composition, of a succinimide dispersant;

wherein base oil (A) is derived at least in part from a C u olefin and further wherein base oil A has a weight average molecular weight of from about 300 g/mol to about 1000 g/mol.

9. The method of claim 8, wherein the one or more PAO base oils are derived from a $C_8$ to $C_{12}$ alpha olefin.

10. The method of claim 8, wherein the lubricating oil composition comprises from about 8 wt. % to about 12 wt. %, based on the total weight of the lubricating oil composition, of the one or more base oils (A).

11. The method of claim 8, wherein the one or more base oils (B) comprise one or more Group III base oils, one or more Group IV base oils or mixtures thereof.

12. The method of claim 8, wherein the succinimide dispersant is derived from a polyalkyene group having a number average molecular weight of from about 1300 to about 2500 Daltons.

13. The method of claim 8, wherein the lubricating oil composition comprises about 0.7 to about 5 wt. %, based on the total weight of the lubricating oil composition, of the succinimide dispersant.

14. The method of claim 8, wherein the lubricating oil composition further comprises one or more lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, and mixtures thereof.

* * * * *